United States Patent [19]

Nidola et al.

[11] Patent Number: 4,548,697

[45] Date of Patent: Oct. 22, 1985

[54] LOW OXYGEN OVERVOLTAGE LEAD ANODES

[75] Inventors: Antonio Nidola; Oronzio de Nora, both of Milan, Italy

[73] Assignee: Oronzio de Nora Impianti Elettrochimici S.p.A., Milan, Italy

[21] Appl. No.: 568,766

[22] Filed: Jan. 6, 1984

[30] Foreign Application Priority Data

Feb. 14, 1983 [IT] Italy ..... 19565 A/83

[51] Int. Cl.[4] ..... C25B 11/00

[52] U.S. Cl. ..... 204/290 R; 502/101; 427/126.6

[58] Field of Search ..... 502/101; 204/290 F, 204/290 R; 427/126.6

[56] References Cited

U.S. PATENT DOCUMENTS

| | | | |
|---|---|---|---|
| 3,616,323 | 10/1971 | Covitz | 204/290 R |
| 4,142,005 | 2/1979 | Caldwell | 204/290 F |
| 4,345,987 | 8/1982 | Fukasawa | 204/290 R |

*Primary Examiner*—John F. Niebling

*Attorney, Agent, or Firm*—Pollock, Vande Sande & Priddy

[57] ABSTRACT

Anodes made of lead or lead alloys, used for the evolution of oxygen from sulphuric acid solutions, particularly in metal electrowinning processes, are made more catalytic by treating them in an oxidizing bath of hydrated molten salts, in particular comprising highly oxidizing persalts or nitrates, of cobalt, iron and nickel.

After treatment, the anodes exhibit an extraordinary low oxygen overvoltage and allow a considerable saving of energy in comparison with untreated anodes.

18 Claims, No Drawings

LOW OXYGEN OVERVOLTAGE LEAD ANODES

The present invention broadly concerns non-corrodible anodes based on lead or lead alloys for the evolution of oxygen from acid solutions, suitable for use in electrowinning processes for recovering metals from solutions of their salts and, more generally, in every electrolytic process wherein the requisites of the material used for the anode are similar.

In particular the invention concerns lead or lead alloys anodes activated on their surfaces in order to reduce the oxygen overvoltage and the process for making the same.

Anodes based on lead or lead alloys, such as, for example:

lead-silver (0.5–1.5%)
lead-calcium (0.5–1%)
lead-antimony (1–5%)
lead-antimony (1%)-silver (0.5%)

are well known and readily available on the market. They are mainly used in electrolytic process for the recovery of metals from aqueous solutions of their respective sulphates.

Copper, zinc, manganese, cadmium, nickel, cobalt, chromium and antimony are some of the metals commonly produced through electrolysis of aqueous solutions of their sulphates utilizing anodes made of lead, lead-silver or lead-antimony-silver.

In said electrowinning processes the anodes primarily must be substantially non corrodible, in order not to poison the electrowon metal which is deposited onto the cathode, and at the same time the anodes must be capable of discharging oxygen at an overvoltage as low as possible in order to contain the energy consumption of the electrolytic process.

Lead or lead alloys are sufficiently non corrodible under anodic conditions in the non-oxidizing, acidic electrolytes commonly used in the aforesaid processes for metal recovery, that is to say in the aqueous solutions containing the sulphates of the metals to be recovered which may contain or not sulphuric acid, and the anodic potential under the most typical working conditions of the said industrial processes is generally comprised between 1.9 and 2.2 V (NHE) (normal hydrogen scale). Therefore said materials are widely used as anodes in the aforesaid processes.

In particular, the characteristics of commercial anodes under most typical working conditions, that is: maximum current density of about 450 A/m$^2$ and temperature comprised between 40° and 80° C., may be indicated as follows:

| Anode Material | Anode Potential V (NHE) | Lifetime years |
|---|---|---|
| Lead (Pb) | 2.0 | 1.5 |
| Lead-silver (Pb—Ag) | 1.9 | 2.0 |
| Lead-silver-antimony (Pb—Ag—Sb) | 1.9 | 2.5 |

It is an object of the present invention to provide an anode based on lead or lead alloys, exhibiting improved overvoltage characteristics to the discharge of oxygen, compared with the known anodes based on lead or lead alloy.

It is another object of the present invention to provide a process for improving the overvoltage characteristics of anodes made of lead or lead alloys.

The anode of the present invention consists of a base of lead or of antimony free lead alloy, activated on its surface by a treatment in a molten salt bath containing a hydrated nitrate and/or persalt having oxidizing properties, for example, acid persulphates, percarbonate, perborates and perphosphates, of at least one metal belonging to the group comprising cobalt, iron and nickel.

The anode of the present invention shows a reduction of the anodic potential comprised between 0.15 and 0.25 V (NHE) with respect to the anodic potential of an untreated anode operating under the same working conditions.

The process of the present invention essentially comprises contacting the surface of an anode made of lead or of antimony free lead alloy, with a molten salt bath of a hydrated nitrate and/or of an oxidizing persalt of at least one metal belonging to the group consisting of cobalt, iron and nickel, maintained at a temperature below the melting point of lead or of the lead alloys, for a time sufficient for activating the anode surface thus treated.

The duration of the contact is preferably comprised between 20 minutes and three hours, depending on the bath temperature. For example, if the temperature of the molten salt is maintained in the range of 90° to 100° C., the duration of the contact is preferably comprised between one hour and three hours. If the temperature of the molten salt bath is increased and it is in the range of 150°–200° C., the contact time may be reduced to about 20 to 30 minutes.

The mechanism or mechanisms concerning the physical-chemical modifications of the surface of the lead or lead alloy anode due to the treatment of the present invention and which are responsible for the marked activation of the surface with respect to oxygen evolution, which activation is confirmed by the extraordinary reduction of the anode overvoltage, cannot be clearly defined with absolute certainty. However, based on analytical and experimental observations, the applicants believe that the modifications of the anode surface may be explained according to the scheme herebelow described, wherein reference is made to the use of hydrated cobalt nitrate ($Co(NO_3)_2.6H_2O$) and which scheme may be considered valid also in the case of the other hydrated oxidizing salts being used.

1. Composition of the hydrated molten salt bath

Cations: $CO^{2+}H^{+}$
Anions: $NO_3^{-}OH^{-}$

2. Reactions occurring in the molten salt bath 2.1. Acidic hydrolysis $$Co(NO_3)_2+2H_2O \rightarrow Co(OH)_2+2HNO_3(\text{weak base})+(\text{strong acid})$$

2.2. Superficial pickling of the lead or lead alloy base by the molten nitric acid:

$$Pb+2HNO_3 \rightarrow Pb(NO_3)_2+(H_2)\downarrow$$

with loss of Pb as nitrate.

2.3. Chemical precipitation of cobalt oxy-salts onto the lead base surface:

$$Co^{2+}+2HO^{-} \rightarrow Co(OH)_2$$

2.4. Chemical interaction between the lead and the cobalt:

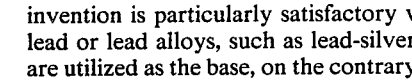

$$XPb(NO_3)_2+Co(OH)_2 \rightarrow Pb_XCo_{1-X}(OH)_2+XCo(NO_3)_2$$

2.5. Precipitation-formation onto the anode surface of a compound of the type $Pb_XCo_YO_Z$ having highly catalytic properties and substantially stabile under the working conditions of the anode.

It has been found that the treatment of the present invention is particularly satisfactory when commercial lead or lead alloys, such as lead-silver or lead-calcium, are utilized as the base, on the contrary no improvement has been observed when the lead base contains antimony.

It is believed that the presence of antimony in the lead alloy base exerts an inhibitory action upon the formation of catalytic compounds of chemical interaction between the lead of the base and the cobalt or the iron or the nickel, according to the scheme described above.

Further it has been found that the molten salts for the treatment of the present invention must contain some water of crystallization. In comparable tests carried out utilizing anhydrous salts, no activation of the lead base has been observed.

Various examples of preferred embodiments of the present invention are reported hereinbelow, however, it is to be understood that the invention is not intended to be limited by the specific examples.

EXAMPLES

Various sample anodes have been prepared utilizing different commercial lead alloys and subjecting the samples to the treatment of the invention, that is immersion in a hydrated molten salt bath, according to the process of the present invention. The characteristics of the lead bases and of the treatment conditions are reported in Table 1.

TABLE 1

| Sample No. | Lead Base Composition | Molten Salt Bath Composition | Molten Salt Bath Temperature | Immersion Time |
|---|---|---|---|---|
| 1 | Commercial Pb | $Co(NO_3)_2.6H_2O$ | 90-100° C. | 3 hours |
| 2 | " | $Fe(NO_3)_2.6H_2O$ | 90-100° C. | 3 hours |
| 3 | " | $Ni(NO_3)_2.6H_2O$ | 90-100° C. | 3 hours |
| 4 | " | $Co(NO_3)_2.6H_2O$ | 120-130° C. | 1 hour |
| 5 | " | $Co(NO_3)_2.6H_2O$ | 150-160° C. | 40 minutes |
| 6 | " | $Co(NO_3)_2.6H_2O$ | 190-200° C. | 20 minutes |
| 7 | " | $Co(S_2O_8)_3.7H_2O$ | 90-100° C. | 3 hours |
| 8 | Pb—Ag (0.5%) | $Co(NO_3)_2.6H_2O$ | 90-100° C. | 3 hours |
| 9 | Pb—Sb (3%) | $Co(NO_3)_2.6H_2O$ | 90-100° C. | 3 hours |
| 10 | Pb—Sb (3%) | $Fe(NO_3)_2.6H_2O$ | 90-100° C. | 3 hours |
| 11 | Pb—Sb (3%) | $Ni(NO_3)_2.6H_2O$ | 90-100° C. | 3 hours |
| 12 | Pb—Ca (0.5%) | $Co(NO_3)_2.6H_2O$ | 90-100° C. | 3 hours |
| 13 | Pb—Ag (0.5%)-Sb (1%) | $Co(NO_3)_2.6H_2O$ | 90-100° C. | 3 hours |

The anodes thus prepared have been electrochemically characterized under different electrolysis conditions and compared with reference anodes consisting of the corresponding untreated lead base.

A first test environment has been sulphuric acid electrolysis under the following conditions:

electrolyte: $H_2SO_4$—10% by weight
current density: 400 A/m$^2$
temperature: 35°-40° C.

The working data of the various samples are reported in Table 2, wherein also the anodic potential of the corresponding reference untreated anode is reported.

TABLE 2

| Sample No. | Anodic Potential in V (NHE) Initial | After 8 h | After 500 h | At 1200 h | Untreated Reference Anode | Anodic Potential in V (NHE) at 1200 hours |
|---|---|---|---|---|---|---|
| 1 | 1.88 | 1.75 | 1.81 | 1.80 | Pb | 2.0 |
| 2 | 1.87 | 1.81 | 1.84 | 1.85 | Pb | 2.0 |
| 3 | 1.90 | 1.81 | 1.88 | 1.92 | Pb | 2.0 |
| 4 | 1.86 | 1.82 | 1.83 | 1.83 | Pb | 2.0 |
| 5 | 1.84 | 1.80 | 1.82 | 1.82 | Pb | 2.0 |
| 6 | 1.81 | 1.81 | 1.86 | 1.86 | Pb | 2.0 |
| 7 | 1.90 | 1.83 | 1.85 | 1.85 | Pb | 2.0 |
| 8 | 1.85 | 1.72 | 1.75 | 1.75 | Pb—Ag | 1.9 |
| 9 | 1.88 | 1.82 | 1.86 | 1.92 | Pb—Sb | 1.95 |
| 10 | 1.86 | 1.81 | 1.90 | 1.94 | Pb—Sb | 1.95 |
| 11 | 1.87 | 1.81 | 1.85 | 1.93 | Pb—Sb | 1.95 |
| 12 | 1.85 | 1.74 | 1.77 | 1.76 | Pb—Ca | 1.95 |
| 13 | 1.82 | 1.74 | 1.82 | 1.87 | Pb—Ag—Sb | 1.9 |

The same sample anodes have been tested for electrowinning zinc from zinc soluphate under the following conditions:

electrolyte: $H_2SO_4$ (10% by weight) $ZnSO_4$ (50 g/l)
current density: 400 A/m$^2$
temperature: 35°-40° C.

The working data of the various sample anodes are reported in Table 3, wherein also the anodic potential of the corresponding reference untreated anode is reported.

TABLE 3

| Sample No. | Anodic Potential in V (NHE) After 100 h | At 500 hours | Reference Anode | Anodic Potential (NHE) at 500 h |
|---|---|---|---|---|
| 1 | 1.80 | 1.79 | Pb | 2.0 |
| 2 | 1.82 | 1.83 | Pb | 2.0 |
| 3 | 1.85 | 1.88 | Pb | 2.0 |
| 4 | 1.81 | 1.84 | Pb | 2.0 |
| 5 | 1.82 | 1.80 | Pb | 2.0 |
| 6 | 1.81 | 1.77 | Pb | 2.0 |
| 7 | 1.83 | 1.85 | Pb | 2.0 |
| 8 | 1.77 | 1.78 | Pb—Ag | 1.9 |
| 9 | 1.83 | 1.91 | Pb—Sb | 1.95 |
| 10 | 1.81 | 1.93 | Pb—Sb | 1.95 |
| 11 | 1.85 | 1.89 | Pb—Sb | 1.95 |
| 12 | 1.83 | 1.74 | Pb—Ca | 1.95 |
| 13 | 1.85 | 1.81 | Pb—Ag—Sb | 1.9 |

The tests carried out clearly demonstrate the marked improvement of the catalytic properties provided by the treatment of the invention for anodes based on lead, lead-silver and lead-calcium alloys.

The anodes of the present invention show a reduction of their anodic potential comprised between 0.15 and 0.25 V (NHE) with respect to corresponding conventional untreated anodes. The advantages afforded by the present invention are not achieved when a lead base containing antimony is utilized. In this case the treated anodes, although showing a greater catalytic activity at the start, tend to reach the same anodic potential of the untreated anodes within a few hours. This seems to give credit to the assumption that the presence of antimony somehow inhibits the formation of catalytic stable compounds between the lead of the base and the cobalt of the iron or the nickel, coming from the treating molten bath, which conversely seems to take place when the lead base is free from antimony.

We claim:

1. The process for preparing catalytic lead base anode having improved oxygen overvoltage wherein an antimony-free lead base is contacted with a molten bath of at least a hydrated salt belonging to the group of nitrates and persalts of a member of the group of cobalt, iron, and nickel, at a temperature lower than the melting temperature of the lead base and for a time sufficient to activate the surface of the lead base anode and wherein said antimony-free lead base exhibits improved oxygen overvoltage as a consequence of said process.

2. The process of claim 1 wherein the molten bath is of hydrated cobalt nitrate.

3. The process of claim 1 wherein the persalts are members of the group of acid persulphates, percarbonates, perborates and perphosphates.

4. The process of claim 1 wherein the lead base is an alloy of lead and silver.

5. The process of claim 1 wherein the lead base is an alloy of lead and calcium.

6. An activated catalytic antimony-free lead base anode having improved oxygen overvoltage prepared by contacting the antimony-free lead base with a molten bath of at least one hydrated salt belonging to the group of nitrates and persalts of a member selected from the group of cobalt, iron, and nickel at a temperature lower than the melting temperature of said antimony-free lead base and for a time sufficient to activate the surface and obtain said activated catalytic lead base anode and wherein said lead base exhibits improved oxygen overvoltage as a consequence of the process by which it was prepared.

7. The process of claim 1 wherein said time is between twenty minutes and three hours.

8. The process of claim 1 wherein said time is between one and three hours and said temperature is 90°-100° C.

9. The process of claim 1 wherein said time is about twenty to thirty minutes and said temperature is 150°-200° C.

10. The process of claim 1 wherein said improved oxygen overvoltage results in a reduction in anodic potential between 0.15 and 0.25 volts as compared to anode not subjected to said process.

11. The process of claim 1 wherein said base is lead.

12. The process of claim 4 wherein said lead base is an alloy of lead and 0.5-1.5% silver.

13. The process of claim 5 wherein said lead base is an alloy of lead and 0.5-1% calcium.

14. The anode of claim 6 wherein said base is lead.

15. The anode of claim 6 wherein said base is an alloy of lead and silver.

16. The anode of claim 15 wherein said base is an alloy of lead and 0.5-1.5% silver.

17. The anode of claim 6 wherein said base is an alloy of lead and calcium.

18. The anode of claim 17 wherein said base is an alloy of lead and 0.5-1% calcium.

* * * * *